US010026578B2

(12) United States Patent
Nan

(10) Patent No.: US 10,026,578 B2
(45) Date of Patent: Jul. 17, 2018

(54) BREAKER FACILITATING RAPID MOVEMENT AND ELONGATION OF ARC

(71) Applicant: BEIJING PEOPLE'S ELECTRIC PLANT CO., LTD., Beijing (CN)

(72) Inventor: Yin Nan, Beijing (CN)

(73) Assignee: BEIJING PEOPLE'S ELECTRIC PLANT CO., LTD., Beijing (CN)

( * ) Notice: Subject to any disclaimer, the term of this patent is extended or adjusted under 35 U.S.C. 154(b) by 0 days.

(21) Appl. No.: 15/311,112

(22) PCT Filed: Mar. 20, 2015

(86) PCT No.: PCT/CN2015/074657
§ 371 (c)(1),
(2) Date: Nov. 14, 2016

(87) PCT Pub. No.: WO2015/172605
PCT Pub. Date: Nov. 19, 2015

(65) Prior Publication Data

US 2017/0098521 A1 Apr. 6, 2017

(30) Foreign Application Priority Data

May 16, 2014 (CN) ..... 2014 1 0206778

(51) Int. Cl.
*H01H 73/04* (2006.01)
*H01H 73/18* (2006.01)
*H01H 33/76* (2006.01)

(52) U.S. Cl.
CPC ..... *H01H 73/04* (2013.01); *H01H 33/765* (2013.01); *H01H 73/18* (2013.01)

(58) Field of Classification Search
CPC ..... H01H 73/04; H01H 73/18; H01H 73/765; H01H 9/44; H01H 71/10; H01H 71/0235;
(Continued)

(56) References Cited

U.S. PATENT DOCUMENTS 3,564,184 A * 2/1971 Gauthier ..... H01H 1/225 200/244
3,742,403 A * 6/1973 Nicol ..... H01H 71/465 335/13

(Continued)

FOREIGN PATENT DOCUMENTS

CN 2743961 Y 11/2005
CN 1866434 A 11/2006

(Continued)

OTHER PUBLICATIONS

Translation CN 201655717 (oroginal doc. published Nov. 24, 2010).*

(Continued)

*Primary Examiner* — Renee S Luebke
*Assistant Examiner* — William Bolton
(74) *Attorney, Agent, or Firm* — MH2 Technology Law Group LLP

(57) ABSTRACT

A breaker comprises a static contact, a moving contact, and an arc-extinguishing chamber. A contact surface of an electrical contact of the static contact and an electrical contact of the moving contact and a bottom plane of a base form an acute angle that is located in the first quadrant. The moving contact comprises a conducting rod having a projecting portion, and the electrical contact which is welded on an end surface of the projecting portion in a direction facing the electrical contact of the static contact. A bottom arc-ignition grid plate on the bottom of the arc-extinguishing chamber is arranged lower than the electrical contact of the static contact. A top arc-ignition grid plate on the top of the arc-extinguishing chamber is arranged higher than the maximum position of the electrical contact of the moving contact when the moving contact is opened.

9 Claims, 4 Drawing Sheets

(58) Field of Classification Search
CPC ..... H01H 71/025; H01H 1/2041; H01H 9/30; H01H 33/04; H01H 33/62
USPC ..... 218/90, 16, 15, 34, 36, 40, 46, 48, 81, 218/149, 150, 113, 105, 41, 38, 37, 20, 218/19, 17, 1
See application file for complete search history.

(56) References Cited

U.S. PATENT DOCUMENTS

| | | | | | |
|---|---|---|---|---|---|
| 3,997,746 | A * | 12/1976 | Harper | H01H 9/342 | 218/149 |
| 4,849,590 | A * | 7/1989 | Becker | H01H 1/54 | 200/10 |
| 4,982,174 | A * | 1/1991 | Fasano | H01H 73/18 | 335/201 |
| 5,210,385 | A * | 5/1993 | Morel | H01H 9/383 | 218/9 |
| 5,293,016 | A * | 3/1994 | Nar | H01H 71/528 | 200/401 |
| 5,317,117 | A * | 5/1994 | Bruski | H01H 9/342 | 218/153 |
| 5,557,082 | A * | 9/1996 | Leet | H01H 71/1027 | 200/50.35 |
| 5,889,249 | A * | 3/1999 | Rival | H01H 9/342 | 218/149 |
| 6,034,586 | A * | 3/2000 | Runyan | H01H 71/1027 | 335/172 |
| 6,248,970 | B1 * | 6/2001 | DiMarco | H01H 9/34 | 218/149 |
| 6,417,474 | B1 * | 7/2002 | Rakus | H01H 9/46 | 218/148 |
| 7,186,941 | B2 * | 3/2007 | Yeon | H01H 9/302 | 218/38 |
| 7,285,742 | B2 * | 10/2007 | Kinzler | H01H 71/0207 | 218/34 |
| 2007/0119819 | A1 * | 5/2007 | Asokan | H01H 9/302 | 218/90 |

FOREIGN PATENT DOCUMENTS

| | | | | | |
|---|---|---|---|---|---|
| CN | 201369303 | Y | | 12/2009 | |
| CN | 201655717 | U | | 11/2010 | |
| CN | 201655747 | U | | 11/2010 | |
| CN | 101546681 | B | | 12/2010 | |
| CN | 102005345 | A | | 4/2011 | |
| CN | 201829430 | U | | 5/2011 | |
| CN | 202150430 | U | | 2/2012 | |
| CN | 102592903 | A | | 7/2012 | |
| CN | 204215989 | U | | 3/2015 | |
| EP | 0359467 | | * | 3/1990 | H01H 9/46 |
| EP | 0359467 | A2 | | 3/1990 | |
| EP | 1085552 | A1 | | 3/2001 | |
| JP | S39029222 | B | | 12/1964 | |
| JP | S54157279 | A | | 12/1979 | |
| JP | S58113948 | U | | 8/1983 | |
| JP | S60049525 | | | 3/1985 | |
| JP | S60246535 | A | | 12/1985 | |
| JP | S6419638 | A | | 1/1989 | |
| JP | H01274335 | A | | 11/1989 | |
| JP | 2006-019113 | A | | 1/2006 | |
| JP | 2007-207512 | A | | 8/2007 | |

OTHER PUBLICATIONS

Translation CN 202150430 (original doc. published Feb. 22, 2012).*
Translation CN 201829430 (original doc. published May 11, 2011).*
Author Unknown, Chinese Office Action dated Nov. 28, 2016, Chinese Application No. 2014102067788, filed May 16, 2014, pp. 1-12 (including English translation).
Japanese Office Action dated Oct. 31, 2017, Japanese Application No. 2016-565474, pp. 1-9 (including English translation).
Japanese Office Action dated Apr. 3, 2018, Japanese Application No. 2016-565474, pp. 1-10 (including English translation).

* cited by examiner

BREAKER FACILITATING RAPID MOVEMENT AND ELONGATION OF ARC

CROSS REFERENCE TO RELATED APPLICATIONS

This application is a national-stage entry of PCT/CN2015/074657, filed Mar. 20, 2015, which claims priority to Chinese Patent Application No. 201410206778.8, filed May 16, 2014, the contents of all of which are hereby incorporated by reference in their entirety.

TECHNICAL FIELD

The present disclosure relates to a field of low-voltage electrical apparatus technology, and in particular, to a breaker for facilitating rapid movement and elongation of an arc.

BACKGROUND

Performance indexes of a breaker serving as an important element among low-voltage electrical apparatuses can restrain development of an industry. In the age of continuous development and growth of new energy, particularly dramatic development of the photovoltaic power generation field, a system voltage of the breaker may be up to 800V, and highland capacity reduction also needs to be considered when the breaker is used on a highland. A multibreak series technology was formerly used to meet the high-voltage demand of a photovoltaic system, but it still has unsolved problems of large volume, high power consumption, great difficulty of construction and installation, etc. The previous application No. 201110005730.7 entitled "Multibreak Breaker" and No. 201020586389.X entitled "Multibreak Plastic Housing Type Breaker" propose a preset wiring technology to solve the problem of construction and installation, but they fails to solve the problems of large volume and high power consumption essentially. An arc extinguishing problem needs to be solved at first if it is desired to replace a multibreak series breaker by a two-electrode breaker to meet photovoltaic application. It is well known that the basic principle of direct current arc extinguishing is arc elongation and arc cooling.

Chinese invention patent application publication CN 101546681 B discloses a breaker capable of protecting a movable contact and facilitating entrance of an arc into an arc extinguishing chamber, of which the primary technical means is as follows: an arc ignition plate electrically connected with a release at a tail portion of the movable contact is provided on an upper end of the arc extinguishing chamber, and an insulating cover is also arranged to avoid a short circuit between the arc and a side of the arc ignition plate near the tail portion of the movable contact, as the arc ignition plate has to penetrate through a region generating an arc when the breaker is disconnected. Due to the arrangement of this arc ignition plate, the arc generated when the movable contact is opened in the case of short circuit can easily skip from the movable contact to the arc ignition plate and enter the arc extinguishing chamber, so that ablative loss of the movable contact is reduced and the arc can easily enter the arc extinguishing chamber. In this technical solution, however, if it is desired that the arc can very easily skip from the movable contact to the arc ignition plate, the resistance of the arc ignition plate needs to be smaller than the parallel resistance of the movable contact and the arc ignition plate, while this is theoretically impossible. Further, one end of the arc ignition plate needs to be electrically connected with the release at the tail portion of the movable contact, the other end of the arc ignition plate shall be arranged above the arc extinguishing chamber, and meanwhile an insulation cover must be arranged for insulation of the arc ignition plate. Therefore, the structure of the arc ignition plate is too complicated, resulting in that assembly of the breaker becomes complicated. Furthermore, the invention is favorable for skipping of the arc from the movable contact to the arc ignition plate and entrance of arc into the arc extinguishing chamber, but has very little effect on elongation of the arc, and thus it is obvious that the effect on arc extinguishing and improvement of working voltage of the breaker is obviously not enough.

SUMMARY

Based on the above problems, an object of the present disclosure is to provide a breaker, which can avoid the problems of large volume and high power consumption brought by multibreak series, and also can facilitate movement and elongation of an arc. The breaker of the present disclosure utilizes movable and fixed contacts with arc ignition structures, matched with an arc extinguishing chamber having arc ignition grid plates and gas producing arc isolation shades to increase moving speed and elongated length of an arc after the movable contact is opened, so as to meet the high voltage requirement of a photovoltaic system.

The present disclosure adopts the following technical solution:

A breaker for facilitating rapid movement and elongation of an arc includes a base, a fixed contact, an arc extinguishing chamber, a movable contact and an operating mechanism, wherein the arc extinguishing chamber is located on the left side of the movable contact, the operating mechanism controls connection/disconnection of the movable contact and the fixed contact;

The fixed contact 1 includes a conductive substrate 11, an arc ignition portion 12 and an electric contact 13, the conductive substrate 11 includes a wiring portion plane 111, a bend 114, a plane 113 and a connection surface 112, the arc ignition portion 12 and the electric contact 13 are fixed on the connection surface 112, and the connection surface 112 forms an acute angle located in a first quadrant relative to a bottom plane 4 of the base;

the movable contact 3 includes a conductive rod 31 provided with a projection portion 314, and an electric contact 32 welded on an end face 313 of the projection portion 314 towards the electric contact 13 of the fixed contact;

the arc extinguishing chamber 2 is a grid plate arc extinguishing chamber, and includes a pair of arc isolation walls 21, arc ignition grid plates and a pair of arc isolation shades 23, the arc ignition grid plates include a bottom arc ignition grid plate 24 the position of which is arranged lower than that of the electric contact 13 of the fixed contact and a top arc ignition grid plate 22 the position of which is arranged higher than a maximum position reached by the electric contact 32 of the movable contact when the movable contact 3 is opened, the arc isolation walls 21 are symmetrically arranged on two sides of the arc extinguishing chamber 2, and the arc isolation shades (23) are arranged on left and right side faces of the movable contact (3).

Movable contacts in parallel with the movable contact 3 are respectively provided on two sides of the movable contact 3.

The arc isolation shade 23 is made of a gas producing material, and is provided with tooth-like projections 232 inserted between grid plates in the arc extinguishing chamber 2, and the arc isolation shade 23 is connected with the arc isolation wall 21 into a whole in a riveting manner or the like.

The distance from the arc isolation shade 23 to a side face 317 of the movable contact is in a range of 0.1-3 mm.

A contact surface 14 of the electric contact 13 of the fixed contact for contacting with the electric contact 32 of the movable contact forms an angle a within the range of 20°-35° relative to a bottom plane 4 of the base.

The arc ignition portion 12 of the fixed contact 1 is arranged immediately close to the electric contact 13 of the fixed contact 1, and in a direction perpendicular to the bottom plane 4 of the base, the arc ignition portion 12 is lower than the electric contact 13; a distance from the arc ignition portion 12 to the bottom arc ignition grid plate 24 in the arc extinguishing chamber 2 is in a range of 0.1-3 mm; the arc ignition portion 12 is fixedly connected to the conductive substrate 11 in a welding, riveting or threaded connection manner or shaped with the conductive substrate 11.

An upper left point 311 is arranged corresponding to the top arc ignition grid plate 22, and in a opening position, a relative distance b between the upper left point 311 and the top arc ignition grid plate 22 is in a range of 0.1-3 mm, and the distance b is smaller than a distance c from the electric contact 32 of the movable contact to an arc extinguishing grid plate corresponding thereto.

The distance with which the contact surface of the electric contact 32 of the movable contact for contacting with the electric contact 13 of the fixed contact protrudes from a lower plane of a rod portion of the conductive substrate of the movable contact is in a range of 4-20 mm.

The left side of the arc ignition portion 12 is arranged correspondingly to the bottom arc ignition grid plate 24 in the arc extinguishing chamber 2, and a relative distance d between the left side of the arc ignition portion (12) and the bottom arc ignition grid plate (24) is in a range of 0.1-3 mm.

The conductive substrate (11) includes a wiring portion plane (111), a bend (114), a plane (113) and a connection surface (112), the arc ignition portion (12) and the electric contact (13) are fixed on the connection surface (112), and the connection surface (112) extends downwards from the plane (113), and forms an angle of 28° with respect to the wiring portion plane (111).

Compared with the prior art, the present disclosure has the advantages that such a breaker can allow an arc generated on the electric contacts of the movable contact and the fixed contact to rapidly move to the upper left point 311 of the projection portion of the movable contact and the lower end of the arc ignition portion 12 of the fixed contact compared with the breaker in the prior art. As shown in FIG. 9, a length of an arc 6 generated at the electric contacts of the movable and fixed contacts is approximately equal to a contact separation 35 of the contacts, while a length of an arc 5 having moved to the upper left point 311 of the projection portion of the conductive rod of the movable contact and the lower end of the arc ignition portion 12 of the fixed contact is 56, that is, the arc at the time of disconnection of the breaker is obviously elongated by 60%.

The present disclosure has a simple structure and requires the same technological level as existing products. The breaker of the present disclosure can be conveniently applied to a breaker for an existing photovoltaic system to reduce a number of breaking points of the breaker, and reduce a volume of the breaker and power consumption, making it possible to use a two-electrode breaker in the photovoltaic system.

DETAILED DESCRIPTION

In order to make the objects, technical solutions and advantages of the present disclosure to be more apparent, the present disclosure is further illustrated below in detail in combination with the accompanying drawings and specific examples.

A plastic housing type breaker generally includes, for each electrode, at least one fixed contact part and at least one movable contact part, when the breaker is closed/opened, these contact parts may be mutually connected/disconnected. Meanwhile, an arc extinguishing device and a set of control mechanism are further arranged in a contact area, wherein the arc extinguishing device is used for extinguishing an arc generated when the movable part is connected/disconnected, and the control mechanism is used for controlling a movement of the movable contact part and driving the connection and disconnection of the movable contact part and the fixed contact part.

The present disclosure relates to a fixed contact part, a movable contact part and an arc extinguishing device in such a breaker, wherein the breaker includes:

a fixed contact mounted on a base, wherein the fixed contact is provided with an electric contact, a plane of the fixed contact on which the electric contact is fixedly connected forms an acute angle located in a first quadrant relative to a bottom plane of the base of the breaker, the fixed contact is further provided with an arc ignition portion, which immediately abuts against the electric contact and is arranged on a conductive substrate, and the arc ignition portion extends to the lowest arc ignition grid plate in the arc extinguishing chamber and has a distance in a range of 0.5-3 mm from the grid plate;

a movable contact including a conductive substrate and an electric point welded on the conductive substrate, wherein the conductive substrate is provided with a projection portion and the electric contact is welded on an end face of the projection portion, the movable contact connects/disconnects with the fixed contact to switch on or switch off a circuit by control of a mechanism; and an arc extinguishing chamber provided with an arc ignition grid plate respectively at each of the top and bottom of the arc extinguishing chamber, wherein the arc extinguishing chamber further includes a pair of arc isolation shades symmetrically arranged inside the arc extinguishing chamber, the arc isolation shade is provided with tooth-like projections inserted between the arc extinguishing grid plates, the arc isolation shade is fixedly connected with the arc extinguishing chamber, and the distance from the arc isolation shade to a side face of the movable contact is in a range of 0.1-3 mm.

The present disclosure is further illustrated as below in combination with the accompanying drawings.

Example 1

Figure 1:
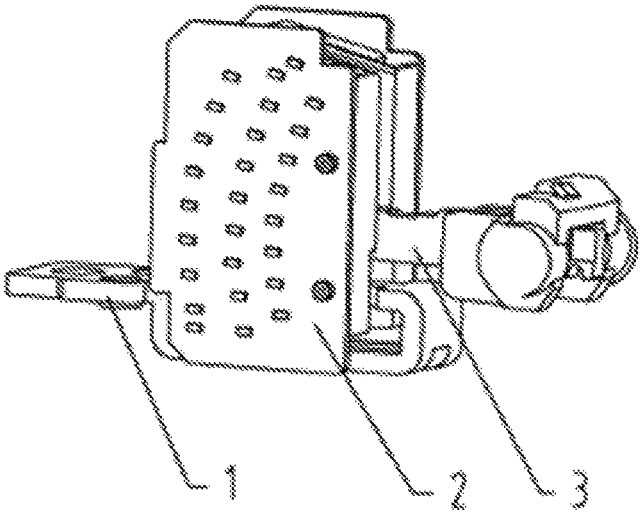
FIG. 1 is an isometric view of Example 1 according to the present disclosure.
Figure 2:
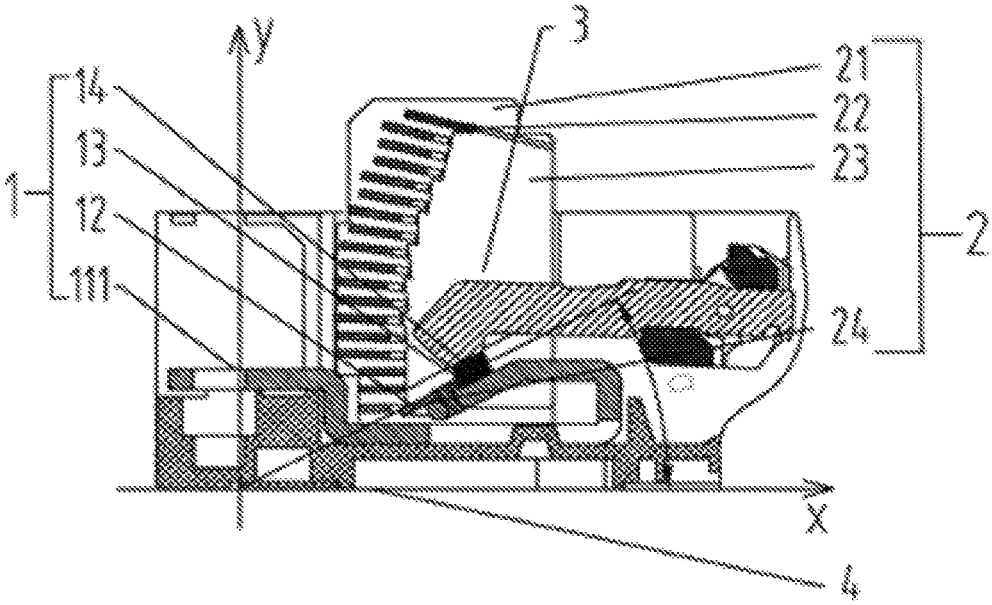
FIG. 2 is a sectional structural diagram of Example 1 according to the present disclosure in a closing state.
Figure 4:
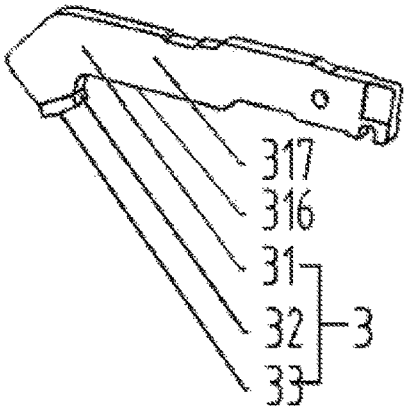
FIG. 4 is an isometric view of a movable contact of Example 1 according to the present disclosure.

As shown in FIGS. 1, 2 and 4, a breaker involved in the present disclosure includes a fixed contact 1, an arc extinguishing chamber 2 and a movable contact 3. Wherein, the arc extinguishing chamber 2 is arranged on the left side of the movable contact 3. A bottom arc ignition grid plate 24 in the arc extinguishing chamber 2 is arranged lower than an electric contact 13 of the fixed contact, and a top arc ignition grid plate 22 in the arc extinguishing chamber 2 is arranged higher than a maximum position reached by an electric contact 32 of the movable contact when the movable contact 3 is opened. A contact surface of the electric contact 13 of the fixed contact for contacting with the electric contact 32 of the movable contact forms an angle a, which is an acute angle located in a first quadrant, relative to a bottom plane 4 of a base. A contact surface 33 of the electric contact 32 of the movable contact for contacting with the electric contact 13 of the fixed contact protrudes from a lower plane 316 of a conductive rod of the movable contact, with a distance greater than 4 mm and smaller than 20 mm.

Figure 6:
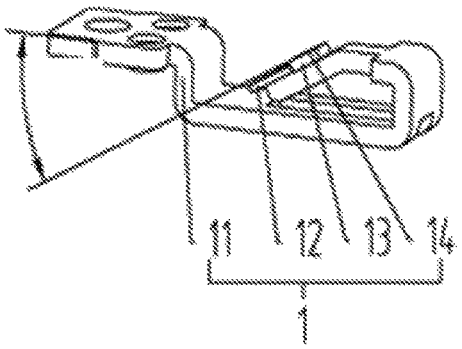
FIG. 6 is an isometric view of a fixed contact of Example 1 according to the present disclosure.
Figure 7:
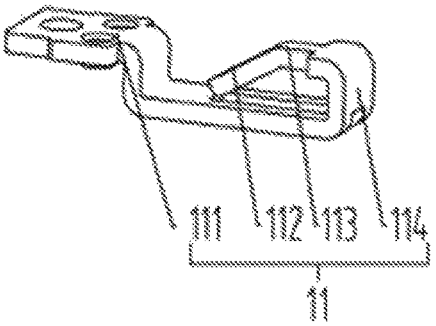
FIG. 7 is an isometric view of a conductive substrate of the fixed contact of Example 1 according to the present disclosure.

As shown in FIGS. 6 and 7, the fixed contact 1 mainly includes a conductive substrate 11 of the fixed contact, an arc ignition portion 12 and the electric contact 13 of the fixed contact. The contact surface of the electric contact 13 of the fixed contact for contacting with the electric contact 32 of the movable contact in FIG. 4 forms an angle a of 28°, with respect to the bottom plane 4 of the base. R. Michal et al. have researched transfer of arc root, wherein cathode and anode arc roots have different transfer modes, and the anode arc root is capable of jumping an obstacle and thus can jump down or jump to pass by at one bound when countering a step or a gap, while the cathode arc root moves continuously and thus it moves continuously along a surface of an obstacle. An upper arc ignition portion 12 is riveted to a plane 112 on which the electric contact 13 of the fixed contact is welded, immediately close to the electric contact 13 of the fixed contact and on a side of the electric contact 13 of the fixed contact near a wiring portion plane 111 of the conductive substrate of the fixed contact. An end of the arc ignition portion 12 near the wiring portion plane 111 of the conductive substrate of the fixed contact extends to a lower side of the bottom arc ignition grid plate 24 in the arc extinguishing chamber 2, being away from the arc ignition grid plate 24 with a distance of 2 mm. As a result, an arc generated on the electric contact 13 of the fixed contact can rapidly move to the arc ignition portion 12 under attraction of the arc extinguishing chamber 2. The arc ignition portion 12 also can be fixedly connected to the conductive substrate of the fixed contact in other manners, for example, welding and threaded connection. Of course, the arc ignition portion 12 also can be directly shaped with the conductive substrate of the fixed contact.

Figure 3:
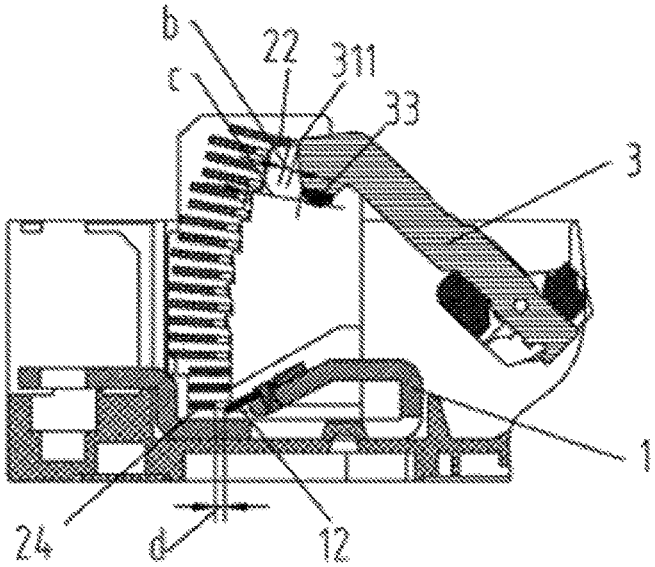
FIG. 3 is a sectional structural diagram of Example 1 according to the present disclosure in a opening state.
Figure 5:
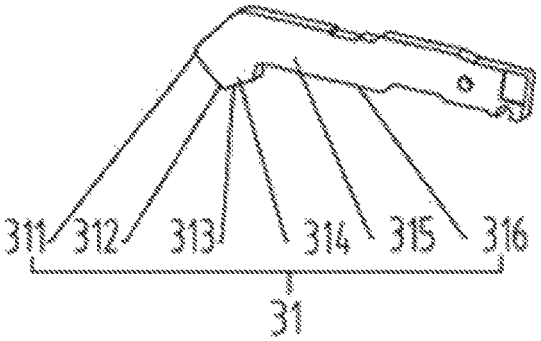
FIG. 5 is an isometric view of a conductive rod of the movable contact of Example 1 according to the present disclosure.

As shown in FIG. 5, a projection portion 314 is provided at a position welded with the electric contact 32 of the movable contact on a front end of a conductive rod 31 of the movable contact. An upper left point 311 and a lower left point 312 of the projection portion are in smooth transition connection. The electric contact 32 is welded on a plane 313 of the projection portion of the conductive rod 31. The arc ignition grid plate 22 is arranged corresponding to the maximum position reached by the upper left point 311 of the projection portion when the movable contact is opened. As shown in FIG. 3, after the movable contact 3 is opened, a distance b from the upper left point 311 of the projection portion on the conductive rod 31 of the contact to the top arc ignition grid plate 22 in the arc extinguishing chamber 2 is less than 1.5 mm, which is less than a distance c from the electric contact 32 of the movable contact to a corresponding arc ignition grid plate. According to results obtained from multiple times of experiments, when a distance difference is more than 3.5 mm, an arc generated on the electric contact 32 of the movable contact when the movable contact is opened will not directly generate a disruptive discharge between the electric contact 32 of the movable contact and a corresponding arc extinguishing plate in a direction of the bottom plane 4 of the base, but due to the attraction of the arc extinguishing chamber 2, can move from the electric contact 32 of the movable contact, along the lower left point 312 of the projection portion and to the upper left point 311 of the projection portion. Further, as shown in FIG. 2, after the breaker is closed, the projection portion 314 is arranged such that a certain gap exists between the plane 316 of the conductive rod of the movable contact and a plane 113 of the conductive substrate of the fixed contact, and the gap can guarantee a reliable contact of the movable contact and the fixed contact after being closed and over-travel abrasion. The assembly connection of a tail portion of the movable contact 3 with a hinge and a release is completely the same as that of the breaker in the prior art.

Figure 8:
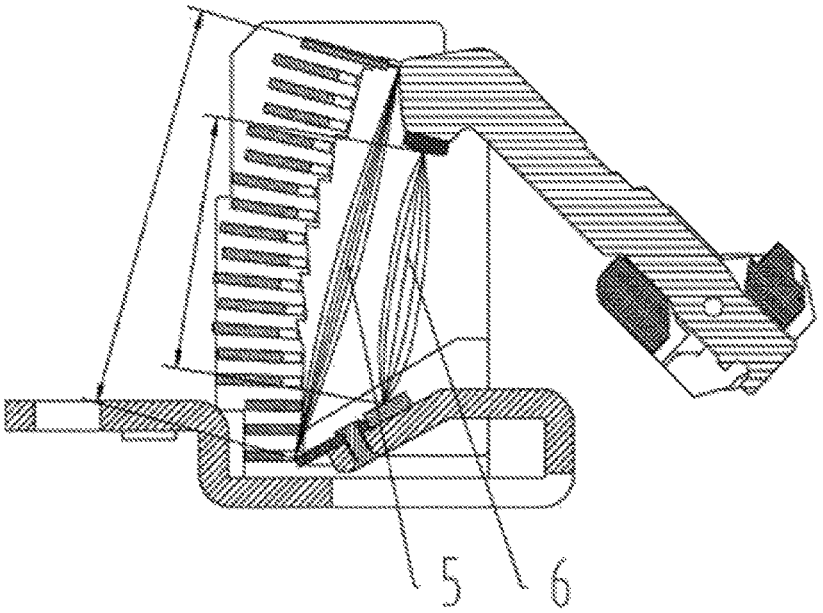
FIG. 8 is an isometric view of an arc isolation shade of Example 1 according to the present disclosure.

As shown in FIG. 8, arc isolation shades 23 are symmetrically arranged inside the arc extinguishing chamber and are a pair of mirror components. The main part of each arc isolation shade forms as a plate, which has tooth-like projections 232 on the side near the arc extinguishing grid plates, and the tooth-like projections 232 are inserted into gaps between the arc extinguishing grid plates. The height of the tooth-like projections 232 needs to guarantee that the arc isolation shades 23 can be reliably pressed against arc isolation walls 21. The tooth-like projections 232 isolate the arc extinguishing grid plates from each other to prevent the arc extinguishing grid plates from being broken down at a side near an operating mechanism under a high voltage case and affecting an arcing length. The arc isolation shade 23 is provided with a protruding semi-hollow cylinder 231 for fixedly connecting the arc isolation shade 23 to the arc isolation wall 21. The arc isolation shade 23 is fixedly connected to the arc isolation wall 21 via the semi-hollow cylinder 231 in a manner of hot rivet. The arc isolation shade can be made of a material with good gas producing capability, such as PA6, POM and the like. The arc isolation shade releases inert gas under high temperature of the arc generated after the movable contact 3 is opened. The inert gas is favorable for blowing the arc towards the arc extinguishing chamber 2 and thus elongating the arc. In the case that the breaking capability is high, it shall be considered to add a fire retardant to the material so as to improve arc ablation resistance of the material. The arc isolation shades 23 symmetrically arranged inside the arc extinguishing chamber are arranged in parallel inside the arc extinguishing chamber 2 and have a distance of 1.5 mm from a side face 317 of the movable contact.

Figure 9:
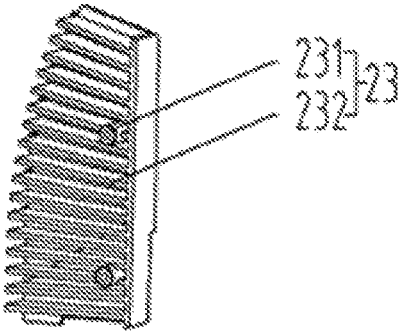
FIG. 9 is an isometric view showing comparison of the present disclosure before and after the arc being elongated.

As shown in FIG. 9, as obtained from multiple times of experiments, based on above-described structure, an arc generated on the electric contacts of the movable contact and the fixed contact when the movable contact is opened can rapidly move to the upper left point 311 of the projection portion of the movable contact and the end of the arc ignition portion 12 near the wiring portion plane 111 of the conductive substrate of the fixed contact under the attraction of the arc extinguishing chamber 2. After the movement, the separation is transferred to an arc ignition separation, which is increased (i.e., the arc is elongated) by 60%. Meanwhile, after rapid movement of the arc, the electric contacts are effectively protected and the electric life times are increased.

Example 2

Example 2 differs from the Example 1 in that the fixed contact can also be in other forms.

Figure 10:
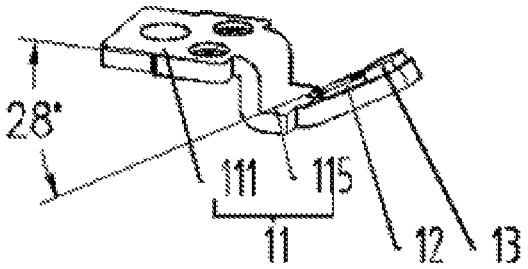
FIG. 10 is an isometric view of a fixed contact of Example 2 according to the present disclosure.

With respect to a fixed contact as shown in FIG. 10, an electric contact 13 of the fixed contact and an arc ignition portion 12 are arranged the same as those in the Example 1. A wiring portion plane 111 of a conductive substrate of the fixed contact is parallel to a bottom plane 4 of a base. A contact surface of the electric contact 13 of the fixed contact for contacting with an electric contact of a movable contact forms an angle of 28° with respect to the wiring portion plane 111 of the conductive substrate of the fixed contact, and extends towards the movable contact from a part 115 below the wiring portion of the conductive substrate of the fixed contact. A part of the conductive substrate for being welded with the electric contact and fixedly connected with the arc ignition portion is formed by bending from a connection surface 115 below the wiring portion of the conductive substrate towards the direction of the movable contact.

Example 3

The Example 3 differs from the above-mentioned Example 1 and Example 2 in that parallel movable contacts are provided on two sides of the original movable contact.

Figure 11:
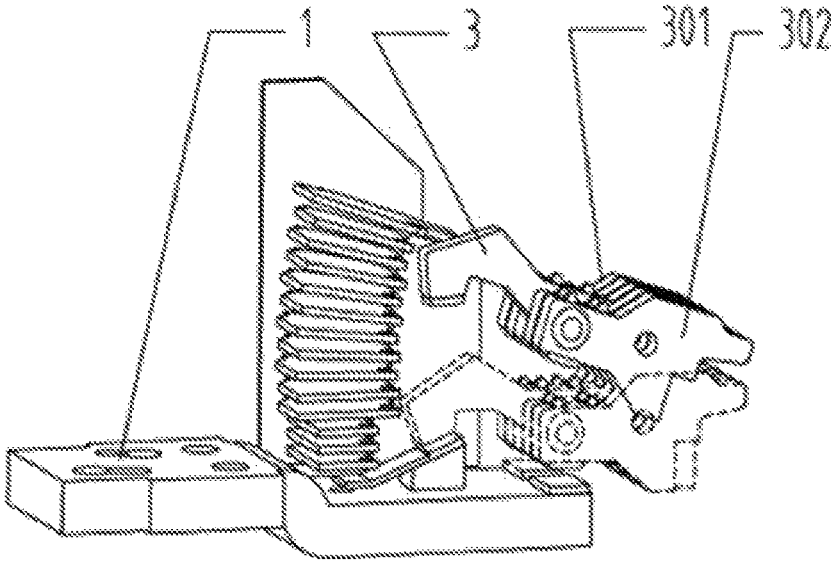
FIG. 11 is a structural diagram showing opening and closing states of Example 3 according to the present disclosure.

As shown in FIG. 11, a fixed contact 1 is the same as that in the Example 2. A movable contact 3 is arranged the same as that in the Example 1. The Example 3 differs from Example 1 and Example 2 in that, a movable contact 301 and a movable contact 302 in parallel with the movable contact 3 are respectively provided on two sides of the movable contact 3, so as to improve a rated current-carrying capability. The movable contacts 301 and 302 are arranged outside of the arc extinguishing chamber. Of course, the number of the movable contacts 301 and 302 can be correspondingly increased or decreased according to a rated working current of the breaker. Further, the movable contacts 301 and 302 can be symmetrically or asymmetrically arranged on the two sides of the movable contact 3. Wherein, the movable contact 3 is closed earlier than the movable contacts 301 and 302 but opened later than the same, which is beneficial for both arc ignition and breaking being completed at the movable contact 3. FIG. 11 also shows a respective state of the movable contact 3 when opening and closing of the movable contact are just performed.

The specific examples described above further illustrate the objects, technical solutions and beneficial effects of the present disclosure in detail. It should be understood that the above examples are merely specific implementations of the present disclosure, but not used for limiting the present disclosure. Any modification, equivalent substitution, improvement and the like made within the spirit and principle of the present disclosure should be incorporated in the protection scope of the present disclosure.

What is claimed is:

1. A breaker for facilitating rapid movement and elongation of an arc, the breaker comprising:

a base;

a fixed contact;

an arc extinguishing chamber comprising arc ignition grid plates;

a movable contact; and an operating mechanism, wherein:

the arc extinguishing chamber is located on a left side of the movable contact;

the operating mechanism controls connection/disconnection of the movable contact and the fixed contact;

the fixed contact comprises a conductive substrate, an arc ignition portion and an electric contact, the arc ignition portion and the electric contact are fixed on a connection surface, and the connection surface forms an acute angle which is located in a first quadrant relative to a bottom plane of the base;

the movable contact comprises a conductive rod provided with a projection portion, and an electric contact welded on an end face of the projection portion and towards the electric contact of the fixed contact; and a contact surface of the electric contact of the fixed contact for contacting with the electric contact of the movable contact forms an angle within a range of 20°-35° relative to the bottom plane of the base.

2. The breaker according to claim 1, wherein the arc extinguishing chamber further comprises a pair of arc isolation walls, arc ignition grid plates, and a pair of arc isolation shades, wherein:

the arc ignition grid plates comprise a bottom arc ignition grid plate, a position of which is arranged lower than that of the electric contact of the fixed contact, and the arc ignition grid plates further comprise a top arc ignition grid plate, a position of which is arranged higher than a maximum position reached by the electric contact of the movable contact when the movable contact is opened;

the arc isolation walls are symmetrically arranged on two sides of the arc extinguishing chamber; and the arc isolation shades are arranged on left and right sides of the movable contact.

3. The breaker according to claim 2, wherein a movable contact and a movable contact in parallel with the movable contact are respectively provided on two sides of the movable contact.

4. The breaker according to claim 3, wherein the arc isolation shade is made of a gas producing material, and is provided with tooth-like projections inserted between the arc ignition grid plates in the arc extinguishing chamber, the arc isolation shade is connected with the arc isolation wall into a whole in a riveting manner, and a distance from the arc isolation shade to a side face of the movable contact is in a range of 0.1-3 mm.

5. The breaker according to claim 4, wherein the arc ignition portion of the fixed contact is arranged adjacent to the electric contact of the fixed contact, and in a direction perpendicular to the bottom plane of the base, the arc ignition portion is lower than the electric contact; a distance from the arc ignition portion to the bottom arc ignition grid plate in the arc extinguishing chamber is in a range of 0.1-3 mm; the arc ignition portion is fixedly connected to the conductive substrate in a welding, riveting or threaded connection manner or shaped with the conductive substrate.

6. The breaker according to claim 5, wherein an upper left point of the projection portion is arranged corresponding to the top arc ignition grid plate, and in a switching-off position, a distance b between the upper left point and the top arc ignition grid plate is in a range of 0.1-3 mm, and the distance b is smaller than a distance c from the electric contact of the movable contact to an arc extinguishing grid plate corresponding thereto.

7. The breaker according to claim 6, wherein a distance with which a contact point of the electric contact of the movable contact for contacting with the electric contact of the fixed contact protrudes from a lower plane of a rod portion of the conductive substrate of the movable contact is in a range of 4-20 mm.

8. The breaker according to claim 7, wherein a left side of the arc ignition portion is arranged correspondingly to the bottom arc ignition grid plate in the arc extinguishing chamber, and a relative distance d between the left side of the arc ignition portion and the bottom arc ignition grid plate is in a range of 0.1-3 mm.

9. The breaker according to claim 8, wherein the conductive substrate includes a wiring portion plane and the connection surface, wherein the arc ignition portion and the electric contact are fixed on the connection surface, and the connection surface forms an acute angle with respect to the wiring portion plane.

* * * * *